United States Patent [19]

Fisher

[11] Patent Number: 4,933,193

[45] Date of Patent: Jun. 12, 1990

[54] MICROWAVE COOKING PACKAGE

[75] Inventor: John R. Fisher, Hockessin, Del.

[73] Assignee: E. I. Du Pont de Nemours and Company, Wilmington, Del.

[21] Appl. No.: 132,003

[22] Filed: Dec. 11, 1987

[51] Int. Cl.[5] ..... B65D 81/34; B65B 29/08; B65B 31/02; B65B 11/52

[52] U.S. Cl. ..... 426/107; 426/113; 426/124; 426/234; 426/396; 219/10.55 E; 53/427

[58] Field of Search ..... 426/107, 113, 234, 243, 426/124, 412, 396; 219/10.55 E; 53/432, 433, 434, 440, 427

[56] References Cited

U.S. PATENT DOCUMENTS

| | | | |
|---|---|---|---|
| Re. 27,136 | 6/1971 | Schmidt | 53/432 |
| 2,830,162 | 4/1958 | Copson et al. | 426/107 |
| 3,230,093 | 1/1966 | Albertus | 426/123 |
| 3,302,632 | 2/1967 | Fichtner | 426/113 |
| 3,467,244 | 9/1969 | Mahaffy et al. | 53/433 |
| 3,481,101 | 12/1969 | Steadman | 53/433 |
| 3,912,823 | 10/1975 | Kane | 426/412 |
| 3,997,677 | 12/1976 | Hirsch et al. | 406/412 |
| 4,190,757 | 2/1980 | Turpin et al. | 426/107 |
| 4,230,924 | 10/1980 | Brastad et al. | 426/107 |
| 4,435,465 | 3/1984 | Ebneth et al. | 428/242 |
| 4,515,850 | 5/1985 | Ishino et al. | 428/242 |
| 4,518,651 | 5/1985 | Wolfe | 426/107 |
| 4,534,984 | 8/1985 | Kuehne | 53/434 |
| 4,590,349 | 5/1986 | Brown et al. | 426/243 |
| 4,594,492 | 6/1986 | Maroszek | 426/243 |
| 4,611,456 | 9/1986 | Gillio-Tos et al. | 53/427 |
| 4,641,005 | 2/1987 | Seiferth | 426/107 |
| 4,703,148 | 10/1987 | Mikulski et al. | 426/243 |
| 4,713,510 | 12/1987 | Quick | 426/107 |
| 4,735,513 | 4/1988 | Watkins et al. | 426/107 |
| 4,775,771 | 10/1988 | Pawlowski et al. | 426/107 |
| 4,777,053 | 10/1988 | Tobelmann et al. | 426/107 |
| 4,780,587 | 10/1988 | Brown | 426/107 |

FOREIGN PATENT DOCUMENTS

| | | |
|---|---|---|
| 3146235 | 5/1983 | Fed. Rep. of Germany . |
| 60-018340 | 1/1985 | Japan . |

*Primary Examiner*—Steven Weinstein

[57] ABSTRACT

A package for microwaving heating or cooking a food item such as an egg roll, which requires surface browning or crispening, comprises a vented tray, a drapable, liquid permeable, microwave susceptive composite material, draped over the food item, and a film lid covering the tray and conformed to the shape of the food item.

8 Claims, 1 Drawing Sheet

MICROWAVE COOKING PACKAGE

BACKGROUND OF THE INVENTION

This invention relates to a package suitable for use in cooking, in a microwave oven, food items which require browning or crispening, and suitable for serving such food items, and a process for packaging such food items by skin packaging processes.

Microwave ovens have become widespread in recent years, and have provided a way to rapidly and conveniently cook many types of foods. Certain foods, however, have proven difficult to heat satisfactorily in a microwave oven. Since microwaves penetrate to the interior of the food and heat from the inside, they tend to drive moisture to the relatively cooler surface of the food, where it may condense. While this phenomenon is not particularly troublesome for many foods, for certain foods it presents serious problems. This is a particular problem for foods such as egg rolls, french fried potatoes, etc., which, when traditionally prepared, have a hot moist interior and a hot, crispy exterior. However, when such food items are cooked in a microwave oven, the result is normally a soggy, unappetizing mass, with no surface crispness at all. To alleviate this problem and aid the browning and crispening of the surface of a cooked food item, there have been developed a number of packaging materials specially adapted for use in microwave cooking. Many such known packaging materials incorporate a microwave susceptor material, i.e., a material capable of absorbing the electric or magnetic portion of the microwave field energy to convert that energy to heat.

U.S. Pat. No. 4,276,420, to Brastad, discloses a packaging material which is a plastic film or other dielectric substrate having a thin semiconducting metallic coating. A food item is wrapped in the coated film so that the film conforms to a substantial surface portion of the food item. On exposure to microwave energy, the film converts some of that energy into heat which is transmitted directly to the surface portion by conduction so that a browning and/or crispening is achieved.

Copending U.S. Pat. Ser. No. 037,987, filed Apr. 13, 1987, now U.S. Pat. No. 4,892,782, Fisher and Huang, discloses composite materials comprising drapable, liquid permeable, woven or non-woven, fibrous dielectric substrates. These substrates, or fibers of these substrates, are coated and/or imbibed with one or more susceptor materials. The composite materials of this application are capable of conforming substantially to the shape of the food item to be browned or crispened. The susceptor material converts a portion of the incident microwave radiation to heat, which imparts rapid browning and/or crispening to the exterior surface of the wrapped food item. The composite material also allows moisture evolved during heating of the food item to readily escape as vapor, thereby aiding and hastening browning and crispening of the food surface.

U.S. application No. 065,982, filed Jun. 24, 1987, now abandoned, discloses a process for skin packaging food, applying a flexible lid to food contained within a tray. The lid is formed from a sheet of plastic which is conformed to the tray and its contents by applying vacuum while the sheet is in a hot, pliable state. The tray is supplied with vents in its walls to permit efficient evacuation of air from the tray.

An object of this invention is to provide a microwave active packaging system for food items.. which permits the food item to be heated or cooked in a microwave oven, while simultaneously providing a browned, crisp surface. Another object of this invention is to provide a package which is convenient to use, and which maintains good contact between the microwave active packaging material and the food item during the course of the heating, and which incorporates a tray which can be used for serving of the food items. Other objects of the invention will become apparent from the discussion which follows.

BRIEF SUMMARY OF THE INVENTION

Accordingly, the present invention provides a skin package useful for storing, heating, browning or crispening, and serving food, said package comprising:

(a) A rigid, gas impermeable tray wherein a food item is placed, said tray comprising a floor, a circumferential wall attached to said floor, and a rim at the upper end of the circumferential wall, wherein the circumferential wall contains a vent;

(b) a microwave susceptive, porous, drapable composite material draped over and contacting said food item; and (c) a polymeric, gas impermeable film covering said tray and food, said film extending across the rim of the tray and extending down the outer portion of the circumferential wall adjacent to the rim in a thermally set crimp, and conforming to the shape of said tray and to the food item and composite material contained therein.

The present invention also provides a process for skin packaging food, comprising the steps of:

(a) placing a food item in a rigid, gas impermeable tray comprising a floor, a circumferential wall attached to said floor, and a rim at the upper end of the wall, wherein the wall contains a vent;

(b) draping a microwave susceptive, permeable, drapable composite material over said food item;

(c) positioning a film above the rim of the tray, said film having sufficient melt strength to be conformable to said tray and food while retaining its integrity;

(d) heating the film until it softens;

(e) placing the film in contact with the rim of the tray such that the film covers the tray; and (f) evacuating the air from the volume contained within the tray, beneath the film, whereby the film conforms to the top of the tray and the food and composite material contained therein.

The invention further provides a process for heating and browning food, comprising the steps of inserting the package of the invention into a microwave oven and heating the food contained therein for a time sufficient to attain the desired degree of heating and browning.

DETAILED DESCRIPTION OF THE INVENTION

This invention provides a packaging means which is also a means for heating or cooking foods which require a crispened or browned surface. Such foods include egg rolls, chicken parts, fish fillets, french fried potatoes, hash brown potatoes, etc.

Figure 1:
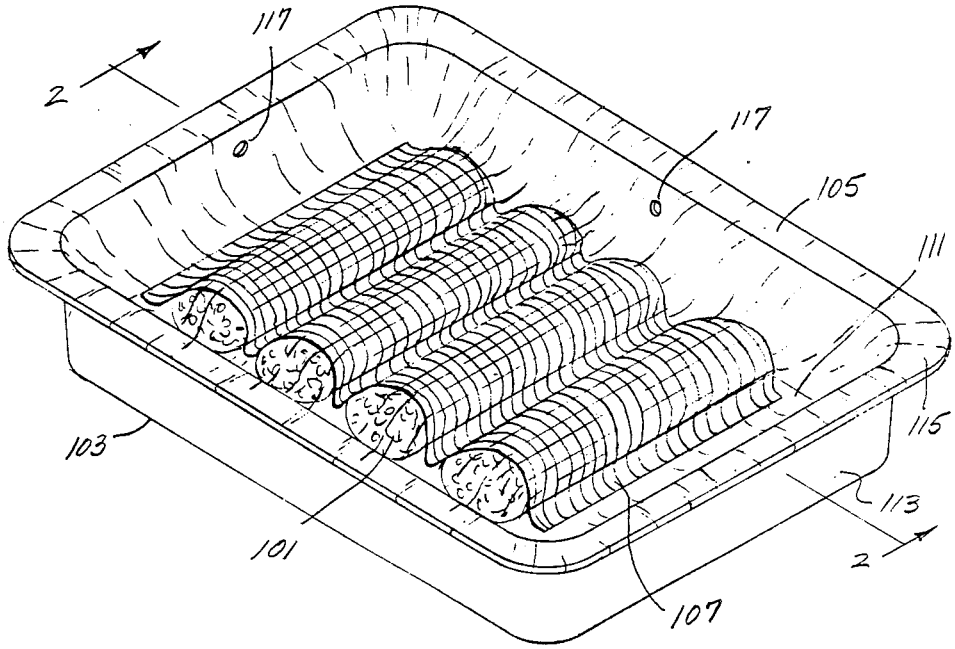
FIG. 1 shows an embodiment of the present invention in perspective view.
Figure 2:
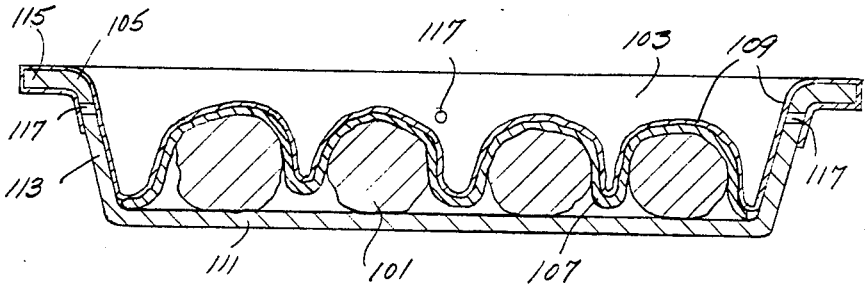
FIG. 2 is a sectional view of FIG. 1, taken along line 2—2.

The packaging process of the present invention uses the well-known process of skin packaging technology, which is described in more detail in U.S. Pat. No. 3,371,464, the disclosure of which is incorporated by reference. In the process of the present invention, food 101 to be packaged is placed into a tray 103, shown in FIGS. 1 and 2 and further described below. There is no particular limitation to the type of food which may be used, although foods which are discrete items, such as fish sticks, egg rolls, french fries or hash brown potatoes, etc., are preferred. The food may be frozen or fresh. It may be placed so that it lies entirely within the tray, below the rim 105 of the tray, or it may be placed so that it extends somewhat above the rim of the tray. The food items may be placed in the tray in any manner desired, but if there are several such food items placed in a single tray, it is often preferable for them to be placed so as to leave a small space between each item, in order to permit more complete exposure of each food item to microwave radiation, and to permit more complete contact of each item with a microwave susceptive composite fabric [107], which covers the items as described below. The food, tray, and fabric are skin packaged. A suitable means for skin packaging is described in U.S. Pat. application Ser. No. 065,982, filed Jun. 24, 1987, the disclosure of which is incorporated by reference.

In the preferred process for skin packaging, one or more of such trays containing food and susceptor fabric covering are inserted into a skin packaging machine on a vacuum platen. The plastic film, which is to form the cover or lid, is placed onto the holding frame of the machine and is secured by the appropriate means. The film is heated, normally by placing a radiant heater within a few centimeters of the film for a few seconds. This heat treatment will heat the film to a temperature which will cause the film to soften and begin to sag or droop. The heating is discontinued, and the air from above the vacuum platen and beneath the film is then removed by use of a suitable vacuum pump. With such a system the film is rapidly vacuum formed while it is still in its warm, pliable condition. The vacuum pulls the film [109] tightly over the special trays such that it conforms to the shape of the food [101] and microwave susceptive fabric 107 within the trays, causes the fabric to be held in tight conformity to the shape of the food, and forms a mechanical crimp or seal over the rim of the tray. Upon cooling the film retains its shape and continues to hold the fabric in conformity to the shape of the food.

After release of the vacuum and removal of the tray from the vacuum platen, the excess film is trimmed from around the edge of the tray, being careful to leave enough film overlapping the rim of the tray to provide a good mechanical seal.

A microwave active, drapable, liquid permeable, woven or non-woven, fibrous, dielectric substrate is placed over the food before skin packaging. This substrate, or fibers of this substrate, are coated and/or imbibed with one or more microwave susceptor materials, the amount of said susceptor material being sufficient to generate adequate heat to rapidly brown or crispen the surface of the food item adjacent thereto without substantially impeding the ability of the microwave energy to penetrate the susceptor material and cook the food item. Such substrates are disclosed more completely in U.S. Ser. No. 037,987, filed Apr. 13, 1987, the disclosure of which is hereby incorporated by reference.

The composite materials which are used are based on cloth, mesh, or paper-like substrates, and are permeable to liquids and vapors, such that moisture evolved during cooking can readily penetrate the material fabric and escape, thus preventing the surface of the food item from becoming soggy. The microwave susceptor materials which are coated onto and/or imbibed into the substrate are materials which are capable of absorbing the electric or magnetic filed components of the microwave energy to convert that energy into heat. Many such materials are known in the art and include metals such as nickel, antimony, copper, molybdenum, bronze, iron, chromium, tin , zinc, silver, gold, aluminum, and alloys, etc. Certain naturally occurring microwave susceptive food ingredients or flavors such as poly- and mono-saccharides and ionically conductive flavoring agents, may also be used, and may impart flavor or aroma to the food. Combinations of the above susceptors may also be used.

In a preferred embodiment, the susceptor material is one which is heated by both the electric and the magnetic field components of the incident microwave radiation. Such material include stainless steel 304, certain nickel/iron/molybdenum alloys such as permaloy, and certain nickel/iron/copper alloys, such as Mu-metal. Such materials are described in more detail in U.S. Pat. No. 4,833,007 , the disclosure of which is hereby incorporated by reference. These materials may be plasma sputtered onto the substrate, or may be present as flakes incorporated in a matrix resin. In another preferred embodiment, the susceptor material is aluminum in flake form. Such flake material will preferably be incorporated in a resinous matrix material, which is, in turn, coated onto the susceptor material. One suitable resinous matrix is a polyester copolymer. The use of aluminum flakes in such a matrix is disclosed in copending application U.S.S.N. No. 002,980, filed Jan. 23, 1987, the disclosure of which is hereby incorporated by reference. Aluminum may also be vacuum deposited directly onto the substrate.

The trays of this invention may be made of any of a variety of materials. They must be made of a material which will satisfactorily hold the food and prevent its drying out upon storage. The material must also be strong enough that it is not damaged by the forces and temperatures encountered in the skin packaging process. Preferably the material will also be able to withstand freezing temperatures without becoming unreasonably brittle, and should withstand temperatures generated in a microwave oven, during the heating of the food items contained therein. Many types of plastics will be satisfactory. Even glass or certain coated, stiff paper products such as ovenable paper board coated with polyester could be used for certain applications. Examples of suitable plastic materials of construction include engineering polymers. Engineering polymers (or engineering plastics) are generally understood in the art as a broad term covering all plastics, with or without fillers or reinforcements, which have mechanical, chemical and thermal properties suitable for use in construction, machine components, and chemical processing equipment. Some examples of suitable engineering polymers include thermosetting polyethylene terephthalate, crystalline polyethylene terephthalate, polyamides, poly-4-methylpent-1-ene, and copolyesters prepared from terephthalic acid and other monomers including 1,4-cyclohexanedimethanol and 2,6-dicarboxynaphthalene. These materials may also contain customary fillers.

The tray may also contain, embedded within it or applied to the upper surface of its floor, microwave susceptor materials, as described above. This embodiment will be preferred when it is desired to brown and crisp the bottom surfaces of food articles to be contained within the tray, as well as the top surfaces.

The shape of the tray may vary considerably, although it will normally be of such a shape as can be used for serving food. A typical tray will normally have a more or less flat bottom or floor [111], without holes, surrounded by a circumferential side or wall [113] of a variety of shapes. The wall need not be a discrete vertical wall, but may generally be a smooth continuation of the bottom of the tray. The top of the wall is terminated by a rim [105], which will preferably have a distinct horizontally extending lip, [115] preferably having a horizontal, radial dimension of about 3 to about 6 mm. If a distinct lip is present, the lid, after vacuum forming, should make contact with both the upper and lower surfaces of the lip, permitting a very tight mechanical seal to be made. However, a distinct lip is not required provided the walls do not rise straight up from the floor, but slope outwards at a sufficient angle from the vertical to permit a tight mechanical seal to be formed by the lid. This is necessary so that the lid will not inadvertently come off the package. An outward slope of the walls of about 45° should be sufficient to permit proper sealing.

Alternatively, the tray may have several compartments, in which various foods may be separately placed, each compartment being separated from the others by a low wall or divider. This type of plate or serving tray is well known, and is normally formed from a single piece of molded plastic.

An important feature of the tray is that the wall has at least one vent [117 in each compartment, such as a hole in the wall or a notch in the rim, which will permit the residual air to escape from beneath the lid film during the vacuum forming process. In order for the tray to be used for storage, heating, and serving of food, it is desirable that the vent be located away from the food, and relatively near the top of the wall, near the rim. The size and shape of the vent is not critical, but it should be large enough that the air contained in the tray can be relatively completely evacuated during the evacuation cycle of the vacuum forming process. The vent should be small enough that it can be readily sealed by the film, as described above. A vent of approximately 0.5 to 2 mm diameter has been found to be suitable for many applications. A plurality of vents may be used for each compartment, to minimize problems that would arise if a single hole were inadvertently plugged, e. g. by a particle of food.

The lid is made from a film which is soft and flexible enough when heated to conform to the shape of the tray, the food, and the susceptor material, in the process described above. Generally a film of plastic will be used. It is important that the film have a sufficient combination of thickness, and melt strength that it will maintain its integrity during the vacuum forming process. By the term "melt strength" is meant the property of the film, which permits it, in a softened state at elevated temperature, to support itself and to be conformed under the influence of vacuum to the desired shape without breaking. It is understood that such films may not be "melted" in the traditional sense, but rather are in a softened, pliable, drapable state. It is also important that the film, after thermoforming, should harden, upon cooling, to form a tight mechanical seal or lock over the lip of the tray. Films made from substantially amorphous polymers tend to exhibit this property. The lid material should preferably also have sufficient high temperature properties to withstand the temperatures generated by heating food in a microwave oven. The required thickness of the film used to form the lid is dependent on the composition of the film, and of the particular packaging application. Generally, films should be about 0.04 mm to about 0.15 mm (about 1.4 mils to about 6 mils) in thickness, before vacuum forming. Preferably the films will be about 0.05 to about 0.13 mm (about 2 mils to about 5 mils) in thickness, before vacuum forming.

Among the polymers which are suitable for the lid are copolymers and partially neutralized copolymers of ethylene with acrylic or methacrylic acid or the like, amorphous polyethylene terephthalate, polybutylene terephthalate, copolyesters of polyethylene terephthalate or polybutylene terephthalate containing comonomers such as oxydiacetic acid, thiodiacetic acid, iminodiacetic acid, succinic acid, adipic acid, dodecanedioic acid, thiobis(phenyleneoxyacetic acid), sulfonylbis(phenyleneoxyacetic acid), phenylenedioxyacetic acid, and the like, polyethylene such as low density polyethylene, high density polyethylene, and linear low density polyethylene, polycarbonates, polyimides, amorphous polyamides, polypropylene, and coextruded film structures incorporating the above structural polymers and barrier resins such as ethylene vinyl alcohol copolymer, nylon, polyvinylidene chloride, or polyacrylonitrile copolymers, with appropriate adhesive tie layers. Coextruded film structures incorporating barrier resins are more fully described in U.S. Ser. No. 909,173, filed Sept. 19, 1986, the disclosure of which is hereby incorporated by reference. Blends of the above polymers may also be used.

Preferred polymers for the film include polycarbonate, amorphous polyethylene terephthalate, and blends of amorphous polyethylene terephthalate with linear low density polyethylene and/or partially neutralized copolymers of ethylene and acrylic or methacrylic acid. A preferred partially neutralized copolymer for this application is a copolymer of ethylene with about 10° methacrylic acid, partially neutralized with zinc ion, having a melt index of about 1.0.

The final package, comprising one or more food items, a tray with vents, a microwave susceptive composite material, and a film lid, may be used for storing or freezing of the food items, and may further be used for cooking of the food items, providing browned and/or crispened surfaces. The microwave susceptive composite material converts some of the microwave energy of the oven into heat, which is transferred to the surfaces of the food items which are in close contact with the microwave susceptive composite material. Because this material is porous, steam generated at the surface of the article being cooked can readily escape, and the surfaces can be dehydrated, browned, and crispened readily.

In order to aid in the escape of the steam from the surface of the food items, it is desirable that the film lid be punctured, loosened, or even removed from the tray before, or shortly after, the heating process begins.

During the heating process, therefore, the microwave susceptive composite material will not necessarily be actively held in as close conformity to the contours of the food items by means of the film lidding as it was before the heating step. A more important function of the film lidding is, rather, to serve as an air-driven piston, causing the susceptive composite material to conform to the surface of the food at the time of packaging. The film will, in addition, help to hold the microwave susceptive composite material in position during handling and storage of the package, and will serve to protect the food from contact with the environment and resultant deterioration. Once actual heating is begun, and the film lidding is removed or loosened,the microwave susceptive composite material will continue to remain in reasonable conformity with the top and sides of the food items, particularly if the composite material has a reasonable degree of dead fold, drapability, or adhesiveness. It is preferred, in order to maximize such contact between the microwave susceptive composite material and the food items, that the composite material be based on a cloth with an open weave, a relatively low denier per filament, and relatively low denier threads.

EXAMPLES

EXAMPLE 1

Four commercial frozen french fries were placed at about 2.5 cm intervals on a tray made of crystalline polyethylene terephthalate, having small holes beneath the rim. A coarse cotton cloth metallized with stainless steel 304, having a surface resistivity of 63 ohms/square, was draped over the french fries as the first layer. A 0.5 mil (0.013 mm) film of polyethylene terephthalate (coated with a layer of copolyester prepared from the condensation of ethylene glycol with terephthalic acid and azelaic acid) was placed over the tray, and the assembly was placed in a bell jar vacuum apparatus. The apparatus was evacuated over a period of 5 minutes to a pressure of about 10 kPa, and the skin was hot wire sealed to the tray at the lip. The vacuum was released and the tray placed on a turntable in a microwave oven ("Amana TM Microcook"). The oven was operated for 1 minute at full power.

The package was removed from the oven, and the film and susceptor cloth removed. All the areas of the french fries which were not resting on the tray (three sides and both ends of all four pieces) were well browned and crisped.

EXAMPLE 2

Two frozen patties of hash brown potatoes (from "OreIda" Division of H. J. Heinz Co.) about 6 mm thick and 2.5 cm in diameter, were placed, about 5 cm apart from each other, on the tray described in Example 1. A susceptor cloth made of Dacron © polyester fiber, and metallized with stainless steel 304 susceptor, surface resistivity 63 ohms/square, was draped over the patties. The plate, cloth, and patties were skin packaged and cooked as described in Example 1. Good browning was observed on the top and sides of the patties.

EXAMPLE 3

A 19 cm diameter round heat-set polyester tray with a 2 cm wall terminating in a lip was provided with four holes approximately 1 mm in diameter, located directly under the lip and spaced approximately 90° from each other. A serving of uncooked scalloped (sliced) potatoes was placed in the dish. A coarse cotton cloth, approximately 8cm×12 cm, which had been vacuum sputter metallized with stainless steel receptor, having a surface resistivity of 63 ohms/square, was placed over the scalloped potatoes. A 5 mil (about 0.13 mm) film of amorphous polyethylene terephthalate film was placed over the tray and its contents. The film and tray were skin packaged using a "Q-Vac" skin packaging machine, as described in U.S. Pat. application No. 065,982. The film acted as an "air piston", pushing the susceptor cloth down upon the potatoes, to provide intimate contact between the food and the susceptor cloth.

The package thus prepared was heated in a 600 watt microwave oven at full power for 2 minutes. The film lid bubbled up slightly and separated from the cloth. The cloth, however, kept close contact with the food. When the cover and the cloth were removed from the food, the potatoes were browned and crispened, much as they would be by conductive cooking in a frying pan.

EXAMPLE 4

Another serving of uncooked scalloped potatoes was placed in the tray of Example 3. A small amount of butter was spread on the top of the potatoes. The potatoes were then treated as in Example 3. After cooking in the microwave oven, the potatoes were pleasingly browned and had the aroma and flavor of potatoes cooked in a frying pan. Similar results can be obtained when the butter is applied to the cloth.

COMPARATIVE EXAMPLE 1

Example 4 was repeated without use of the susceptor cloth. Browning and crisping did not occur, and the final product did not have the pleasing color, aroma, and general appearance of pan fried potatoes.

EXAMPLE 5

Eight uncooked egg rolls, measuring 4×3×1.5 cm, were placed in a rectangular 21×14 cm tray with a 2 cm high wall, terminating in a lip, having four 1 mm holes drilled at equal spacings under the lip. The egg rolls were covered with a glass cloth that had been sputter metallized with stainless steel 304, having a surface resistivity of 125 ohms/square. The package was sealed with a 5 mil (0.13 mm) film as in Example 3.

The resulting package was heated in a 600 watt top fed microwave oven. Since the glass cloth was considered to be too resilient to maintain close product contact in the absence of the lidding, the lidding was not entirely removed, but was pulled up slightly around the edges of the tray to allow escape of moisture during the cooking cycle. The lidding thus still functioned to hold the susceptor cloth in place. The egg rolls were cooked for 2 minutes under full power. They became crisp on the outside, without any sogginess, and the fillings were moist and had not dried out.

COMPARATIVE EXAMPLE 2

To further illustrate the effectiveness of this method of browning and crisping, two egg rolls were prepared as in Example 5, except that only one egg roll was placed under the susceptor impregnated glass cloth, while the other one was not. The egg roll under the cloth was browned and crisped, while the one not under the cloth was not. Moreover, the egg roll under the cloth had a softer and more moist filling.

EXAMPLE 6

A serving of "Tater Tots TM" (from OreIda Division of H. J. Heinz Co.), small round pellets of prebrowned and frozen shredded potatoes, was cooked by the method of the present invention. Ten "Tater Tots TM" approximately 4 cm long and 2 cm in diameter were placed in a 21×14 cm tray made of filled polyamide, having a 2 cm high wall terminating in a lip, and four 1 mm holes equally spaced under the lip. The potatoes were covered with a 10×15 cm stainless steel 304 sputter metallized glass cloth, having a surface resistivity of 125 ohms/square. The plate was skin packaged as in Example 3. The sheet of amorphous polyethylene terephthalate effectively acted as a piston to bring the cloth into intimate contact with all sides of the food (other than the bottom). The package was then cooked in a microwave oven, as described in Example 5, for 1½ minutes. The "Tater Tots TM" were satisfactorily browned and crisped.

COMPARATIVE EXAMPLE 3

Example 6 was repeated without the metallized glass cloth. The resulting product was soggy and unappetizing.

The invention being claimed is:

1. A vacuum skin package useful for storing, heating, browning or crispening, and serving at least one food item, said package comprising:

(a) a rigid, gas impermeable tray comprising a floor, a circumferential wall attached to said floor, and a rim at the upper end of the circumferential wall, wherein the circumferential wall contains at least one vent capable of venting air during vacuum skin packaging;

(b) at least one food item contained in said tray;

(c) a microwave susceptive, liquid and vapor permeable, drapable composite material having sufficient microwave susceptivity to brown or crispen the surface of said at least one food item in a microwave oven without substantially impeding the ability of microwave energy to penetrate the susceptor material and cook said at least one food item, said composite material being draped over and contacting said at least one food item; and (d) a polymeric, gas impermeable film covering said tray, said at least one food item, and said composite material, said film being vacuum skin formed onto said tray such that said film extends across the rim of the tray and down the outer portion of the circumferential wall adjacent to the rim, said film conforming to the shape of said at least one food item and said composite material within the tray and causing the composite material to be held in tight conformity to the shape of said at least one food item, said film further forming a mechanical crimp over the rim of the tray;

said tray and film being sufficiently permeable to microwave radiation to allow said at least one food item to be heated in said package in a microwave oven.

2. The package of claim 1 wherein the microwave susceptive, porous, drapable composite material comprises a fibrous, dielectric substrate, which substrate is treated with at least one microwave susceptor material, the amount of said susceptor material being sufficient to generate adequate heat to rapidly brown or crispen the surface of the food item without substantially impeding the ability of the microwave energy to penetrate the susceptor material and cook the the food item.

3. The package of claim 2 wherein the microwave susceptor material is aluminum flake.

4. The package of claim 2 wherein the microwave susceptive, porous, drapable, composite material is a woven cloth.

5. The package of claim 4 wherein the tray is prepared from a polymeric resin.

6. The package of claim 5 wherein the floor of the tray contains a microwave susceptor material.

7. A process for heating and browning food, comprising the steps of inserting the package of claim 1 into a microwave oven and heating the food contained therein for a time sufficient to attain the desired degree of heating and browning.

8. A process for skin packaging food, comprising the steps of:

(a) placing a food item in a rigid, gas impermeable tray comprising a floor, a circumferential wall attached to said floor, and a rim at the upper end of the wall, wherein the wall contains a vent capable of venting air during vacuum skin packaging;

(b) draping a microwave susceptive, liquid and vapor permeable, drapable composite material over said food item, said composite material having sufficient microwave susceptivity to brown or crispen the surface of said food item in a microwave oven without substantially impeding the ability of microwave energy to penetrate the susceptor material and cook the food item,;

(c) positioning a film above the rim of the tray, said film having sufficient melt strength to be conformable to said tray and food while retaining its integrity;

(d) heating the film until it softens;

(e) placing the film in contact with the rim of the tray such that the film covers the tray, the food item, and the composite material; and (f) evacuating the air from the volume contained within the tray, beneath the film, such that said film conforms to the shape of said food item and said composite material within the tray and causes the composite material to be held in tight conformity to the shape of said at least one food item, said film further forming a mechanical crimp over the rim of the tray;

said tray and film being sufficiently permeable to microwave radiation to allow said at least one food item to be heated in said package in a microwave oven.

* * * * *